US008387668B2

(12) United States Patent
Macquet et al.

(10) Patent No.: US 8,387,668 B2
(45) Date of Patent: Mar. 5, 2013

(54) FILLING MACHINE PROVIDED WITH A CLEANING DEVICE WITH A DEFORMABLE MEMBRANE

(75) Inventors: Philippe Macquet, Octeville sur Mer (FR); Jean-Marie Maubois, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 727 days.

(21) Appl. No.: 12/524,147

(22) PCT Filed: Jan. 16, 2008

(86) PCT No.: PCT/FR2008/000048

§ 371 (c)(1),
(2), (4) Date: Jul. 22, 2009

(87) PCT Pub. No.: WO2008/107539

PCT Pub. Date: Sep. 12, 2008

(65) Prior Publication Data

US 2010/0107557 A1 May 6, 2010

(30) Foreign Application Priority Data

Jan. 22, 2007 (FR) ..... 07 00397

(51) Int. Cl.
*B65B 1/04* (2006.01)

(52) U.S. Cl. ..... 141/91; 141/90

(58) Field of Classification Search ..... 141/90, 141/91; 222/149
See application file for complete search history.

(56) References Cited

U.S. PATENT DOCUMENTS

| | | | | | |
|---|---|---|---|---|---|
| 3,447,281 | A * | 6/1969 | Buford et al. | 53/503 |
| 3,716,083 | A * | 2/1973 | Tuma et al. | 141/90 |
| 4,534,494 | A * | 8/1985 | Hautemont | 222/148 |
| 4,987,934 | A * | 1/1991 | Groom | 141/89 |
| 5,099,895 | A * | 3/1992 | Loeliger | 141/89 |
| 5,562,129 | A * | 10/1996 | Graffin | 141/90 |
| 5,782,274 | A * | 7/1998 | Kaneko et al. | 141/90 |
| 5,865,221 | A * | 2/1999 | Ludwig et al. | 141/31 |
| 6,039,058 | A * | 3/2000 | Fujikawa et al. | 134/104.1 |
| 6,070,622 | A * | 6/2000 | Rutter | 141/90 |
| 6,457,497 | B1 * | 10/2002 | Adriansens et al. | 141/91 |
| 7,686,043 | B2 * | 3/2010 | Berger | 141/91 |

FOREIGN PATENT DOCUMENTS

EP 0574 321 A1 12/1993

* cited by examiner

*Primary Examiner* — Timothy L Maust
(74) *Attorney, Agent, or Firm* — Patterson Thuente Pedersen, P.A.

(57) ABSTRACT

A container filling machine includes at least one filling spout, and a cleaning device including a stationary collecting member with a passage opening, a sealing member that can be displaced between a retracted position and a service position in which said sealing member is capable of tightly sealing the passage opening, and displacement means for displacing said sealing member between the retracted position and the service position thereof. The sealing member includes an elastically deformable membrane mounted on a holder and forming therewith a tight deformation chamber capable of receiving a pressurized fluid in order to deform the deformable membrane for sealing the passage opening when said holder is displaced into the service position by the displacement means.

14 Claims, 7 Drawing Sheets

FILLING MACHINE PROVIDED WITH A CLEANING DEVICE WITH A DEFORMABLE MEMBRANE

PRIORITY CLAIM

The present application is a National Phase entry of PCT Application No. PCT/FR2008/000048, filed Jan. 16, 2008, which claims priority from French Application No. 0700397, filed Jan. 22, 2007, the disclosures of which are hereby incorporated by reference herein in their entirety.

TECHNICAL FIELD

The present invention relates to a filling machine provided with a cleaning device. More particularly, the present invention relates to a rotary machine provided with a plurality of filling spouts for filling hollow containers, such as bottles or pots, with a food product.

BACKGROUND ART

Such rotary filling machines typically comprise a rotary carrousel bearing a tank of filling product and a plurality of filling stations, each filling station comprising a filling spout connected to the tank, a holder system making it possible to hold a container under the filling spout, and metering means for supplying a determined quantity of filling product into each container.

Such machines should be cleaned regularly with a generally liquid cleaning agent, circulated in the machine in place of the filling product, for removing any traces of product, dust or other foreign matters, and/or possible biological or bacteriological contaminants.

In order to limit the consumption of cleaning agent, it has been known to provide cleaning devices that make it possible to recuperate the cleaning agent exiting the filling spouts with a view to recycling it in a closed circuit-fashion.

These cleaning devices may comprise a plurality of mobile collecting members, such as tubes or receivers, each collecting member being vertically movable between a high service position wherein the collecting member comes tightly in contact with a filling spout to recuperate the cleaning agent supplied by said spout, and a low retracted position wherein said tube is spaced apart from said filling spout for allowing the filling of containers. The collecting members are connected to a same annular manifold moveably mounted on a stationary frame for displacing all the collecting members between their two positions by vertical translation.

The collecting members may be press-fitted all together on cylindrical parts of the filling spouts, wiper seals being thus provided to ensure tightness. Such recovery tubes provided with wiper seals and being press-fitted on the spouts, ensure a good tightness, even when the machine comprises a large number of filling spouts, with height differences between the spouts. Nevertheless, their encumbrance may prove to be incompatible with the holder systems of classic containers.

It is also possible to provide collecting members fitted at their upper ends with an O-ring capable of abutting against the external conical surface of the filling spout or against the lower annular edge surrounding the discharge opening of the spout. Such tightness with an O-ring cannot suit a machine provided with a large number of filling spouts, as in practice, the differences in height between the filling spouts will be inevitably higher than the crushing of an O-ring.

According to another type of cleaning device, each filling spout is provided with a stationary collecting member surrounding the discharge opening of the filling spout and which exhibits a passage opening arranged under the discharge opening of the filling spout, as well as an evacuation duct opening into the inner space of the collecting member for evacuating and recycling the cleaning agent. The device thus comprises a sealing member that can be displaced between a retracted position wherein said sealing member is spaced apart from the filling spout to make it possible to fill a container placed under the filling spout, and a service position wherein said sealing member tightly seals the passage opening of the collecting member to carry out cleaning operations.

An upward vertical translation displacement of the sealing members via a joint displacement system, to move them to their service position, presents the same aforementioned encumbrance problems, as well as the same tightness problems when the spouts are not perfectly aligned in height. Some machines are provided with an individual displacement system for each sealing member, the displacement between the service and retracted positions being accordingly achieved by a rotation around an axis perpendicular to the axis of the filling spout. These individual displacement systems are particularly cumbersome, and such a rotation movement requires an important available space under the filling spout and around it.

SUMMARY OF THE INVENTION

The aim of the present invention is to propose a filling machine with a cleaning device overcoming at least one of the aforementioned drawbacks, which particularly enables having a good tightness during cleaning operations, and/or a reduced encumbrance.

To this end, the object of the present invention is a container filling machine comprising

- at least one filling station comprising a filling spout, connected to filling liquid storage means, and
- a cleaning device comprising, for each filling station,
  - a stationary collecting member surrounding the discharge opening of the filling spout and exhibiting a passage opening arranged below the discharge opening of the filling spout,
  - a sealing member that can be displaced between a retracted position wherein said sealing member is spaced apart from the filling spout, to allow the filling of a container placed under the filling spout, and a service position wherein said sealing member is capable of tightly sealing the passage opening of the collecting member in order to carry out cleaning operations, and
  - displacement means for displacing said sealing member between its service position and its retracted position, characterized in that the sealing member comprises an elastically deformable membrane mounted on a holder and forming therewith a tight deformation chamber capable of receiving a pressurized fluid in order to deform the deformable membrane to ensure the sealing of the passage opening when said holder is displaced to the service position by the displacement means.

Thus, according to an embodiment of the invention, the sealing member comprises a deformable membrane that can be inflated to deform it, such that it abuts against the collecting member to seal its passage opening. The sealing device with an inflatable deformable membrane makes it possible to ensure a tight closing of the passage openings during cleaning operations, and particularly, in the case of a machine provided with a plurality of filling spouts, to efficiently compensate for the height differences between the filling spouts and hence to use joint displacement means for displacing the sealing members between their various positions.

According to an embodiment, the deformable membrane is mounted on the upper surface of a holder plate, said holder plate being fitted with a supply channel opening under the deformable membrane, and capable of being supplied with pressurized fluid. Advantageously, the deformable membrane, preferably circular, is mounted in a recess of said holder plate, by means of a mounting flange, said membrane preferably exhibiting a peripheral ridge housed in a corresponding groove of the recess.

According to a feature, the collecting member exhibits a lower edge, preferably circular, defining the passage opening, said deformable membrane being capable of pressing against said lower edge during the pressurizing of the deformation chamber. In an embodiment, the collecting member is formed of a substantially cylindrical skirt in one block with the filling spout. According to a preferred embodiment, the collecting member comprises a lateral duct opening into its inner space for recuperating the cleaning agent supplied by the filling spout.

According to another feature, the displacement means are capable of displacing the holder of the deformable membrane from its retracted position to its service position through at least one downward vertical translation displacement, parallel to the longitudinal axis of the filling spout, followed by a horizontal displacement, perpendicular to the longitudinal axis of the filling spout, such that the deformable membrane is substantially centered with respect to the longitudinal axis of the spout. In its retracted position, the sealing member formed by the membrane on its holder, is arranged over the passage opening, next to the filling spout, and its displacement between its two positions is carried out by combining a vertical movement and a horizontal movement. Such a displacement requires little space under the filling spout, and may particularly be carried out without being hindered by the bottle holder systems. This combination of simple movements particularly makes it possible in the case of a machine fitted with a plurality of filling spouts, to use simple joint displacement means for displacing the assembly of sealing members between their positions.

The horizontal displacement is preferably followed by a upward vertical translation displacement substantially according to the axis of the filling spout to bring the holder of the deformable membrane to the service position.

According to an embodiment, the machine comprises a plurality of filling stations and the deformable membranes on their holder in their retracted position are arranged between the filling spouts; the holders of the deformable membranes are preferably displaced simultaneously between their retracted position and their service position by joint displacement means.

According to an embodiment, the machine is of a rotary-type, said filling stations being arranged at regular angular spaces under a rotary holder, the deformable membranes on their holders are mounted at regular angular spaces on a ring assembled under said rotary holder via vertical translation and rotation displacement means, said horizontal displacement consisting in a rotation around the rotational axis of the rotary holder, at an angle corresponding to a half-pitch between two successive filling spouts.

The holders of the deformable membranes can be formed of an annular holder plate, of one or more parts or portions, assembled to the ring, for example inside the cylindrical wall of the ring, said holder plate being fitted with openings between the deformable membranes to allow for the passage of the filling spouts equipped with their collecting member in the retracted position of the holder plate.

In a particular embodiment, the ring internally bears said holder plate and is fitted with at least two mounting legs extending radially outwards, each leg being assembled by a vertical jack on a carriage that is slidingly mounted on a horizontal guiding rail secured to the rotary holder, at least one jack mounted between the rotary holder and a carriage ensuring the rotational displacement of the ring.

According to an embodiment, the aforementioned filling liquid storage means are an integral part of the machine and are composed of a rotary storage tank, for example annular, the aforementioned rotary holder being formed by the bottom wall of the tank, the filling spouts being directly mounted on this bottom wall.

According to another embodiment, the filling stations are assembled to a rotary holder shaped as an annular plate, and are connected, via a spider-type dispensing system, known per se, to an offset storage tank.

Advantageously, the machine comprises centering means for centering the ring in the retracted position and in the service position; the centering means are formed for example of stoppers on the guiding rail and/or of studs secured to the tank that cooperate with the mounting legs.

Each filling station may comprise container holder means comprising at least one holding member capable of cooperating with the neck of a container, for example a clip-type holding member, capable of gripping the containers by their neck, said deformable membrane on its holder passing between said holding member and the collecting member.

The invention will be better understood, and other objects, details, characteristics and advantages will become more apparent through the following detailed explanatory description of a currently-preferred particular embodiment of the invention, with reference to the accompanying schematic drawings.

DETAILED DESCRIPTION OF THE DRAWINGS

The figures illustrate a rotary filling machine 1 fitted with a cleaning device according to the invention, that is more particularly adapted for filling bottles made of plastic, for example of polyethylene terephthalate, with a liquid such as water, milk or fruit juice. Of course, the invention may be used for filling any type of container with any type of product.

Figure 1:
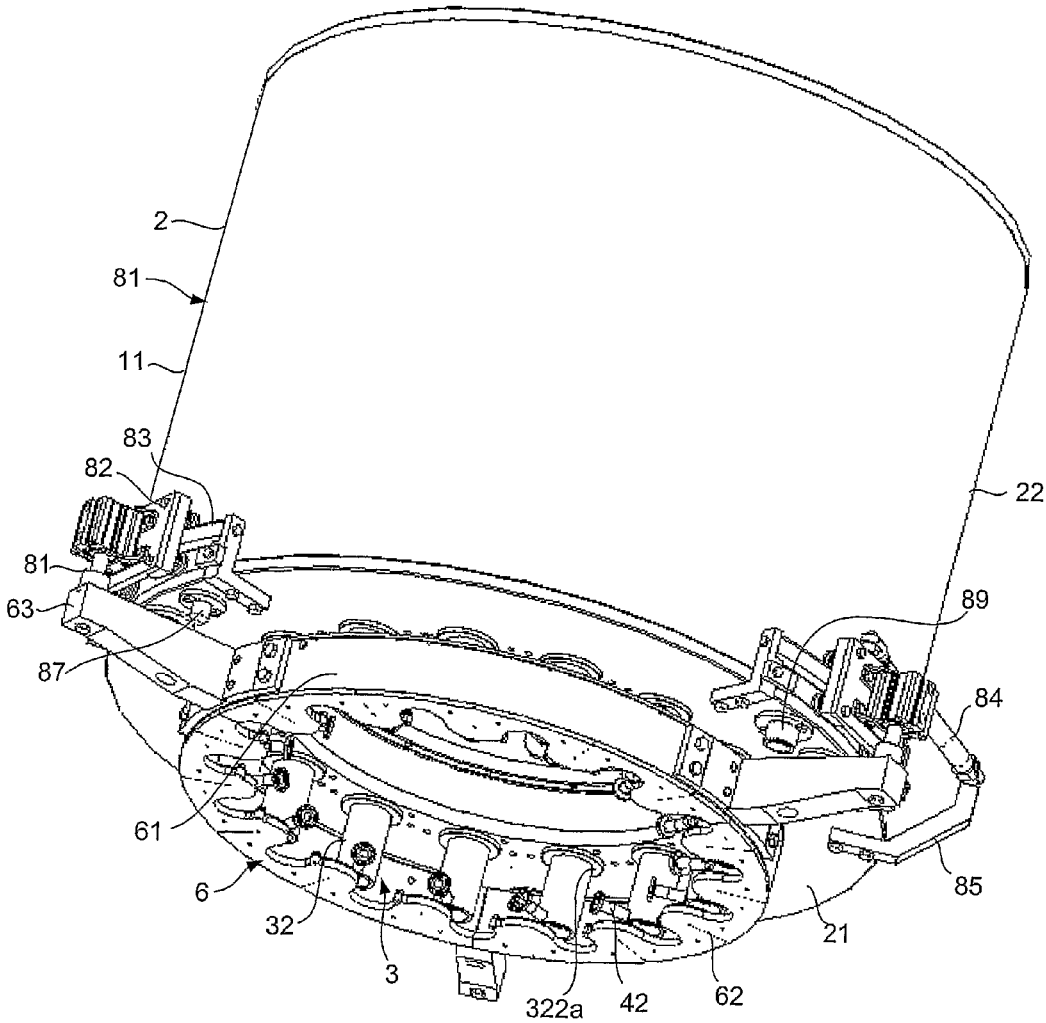
FIG. 1 is a perspective view of a rotary filling machine according to an embodiment of the invention, fitted with a cleaning device.
Figure 5:
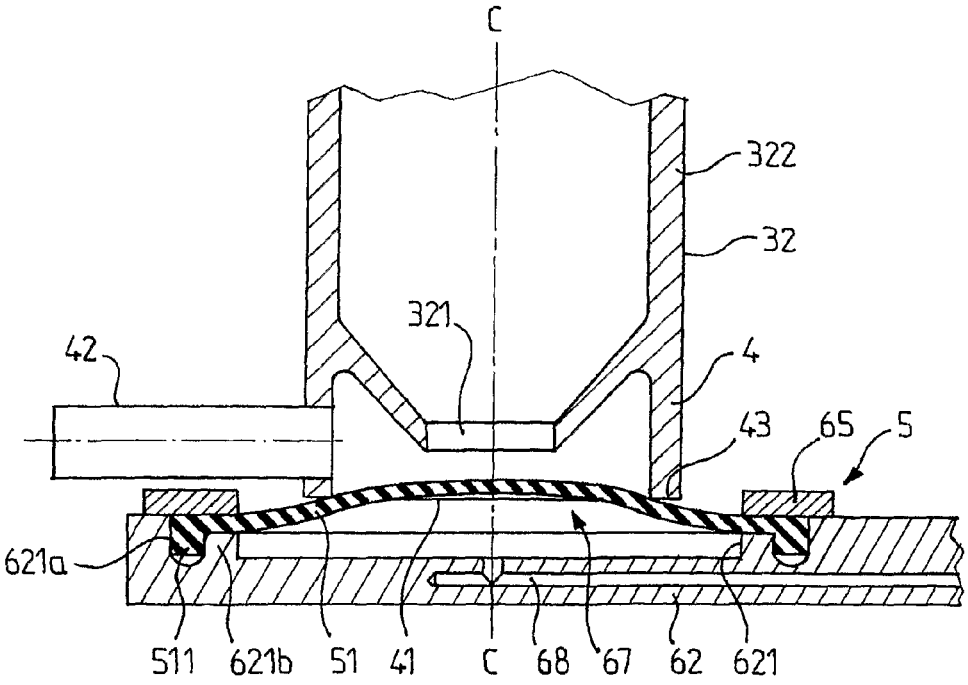
FIG. 5 is a partial schematic cross sectional view of a filling spout and of its related sealing member in the service position and in the inflated state.
Figure 9:
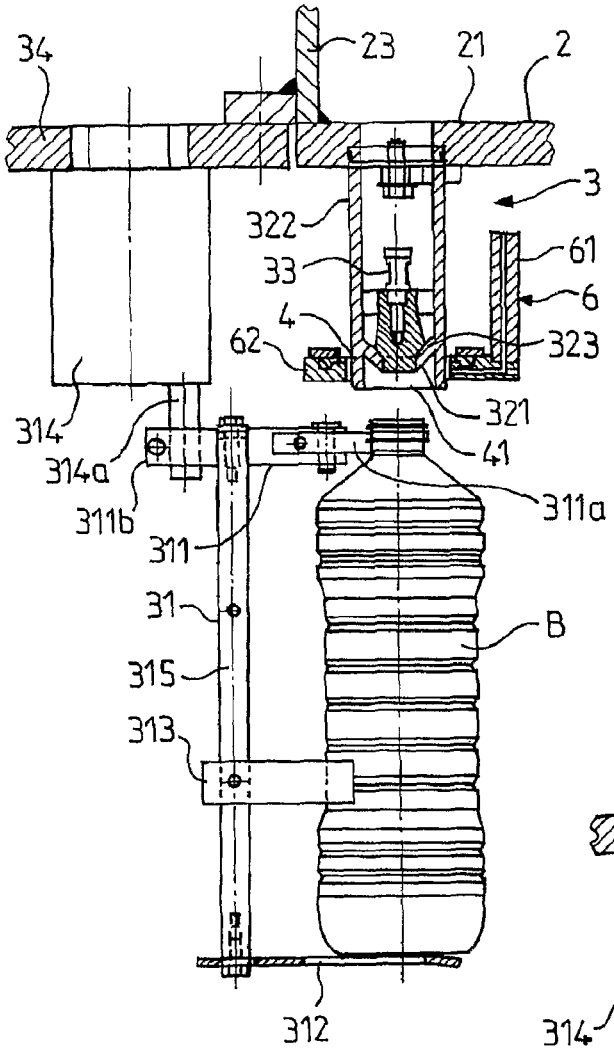
FIG. 9 is a cross sectional schematic view of a filling station with its sealing member in the retracted position; and, FIG. 10 is an analogous view to FIG. 9, with the sealing member in a low intermediary position.

With reference to FIGS. 1, 5 and 9, the rotary machine 1 comprises a carrousel 11 intended to be turningly mounted on a stationary frame (not shown), around a vertical rotation axis. The carrousel bears a cylindrical filling liquid tank 2, and a plurality of filling stations 3 arranged at regular angular spaces around the rotation axis. Each filling station 3 comprises a filling nozzle or spout 32 with a discharge opening 321 in fluid communication with the filling tank, and holder means 31 of a container B, here a bottle, for holding a container under the filling spout. In the present embodiment, the carrousel is formed by an annular tank 2, and the spouts are vertically mounted, directly under a rotary holder 21 here constituted by the bottom wall of the filling tank 2, with their discharge opening 321 oriented downwards.

Each filling spout 32, of longitudinal axis C, comprises an upper cylindrical part 322, fitted with a flange 322*a* for its tight connection to the tank, on the contour of a circular opening of its bottom wall, this upper part extending by a lower tapered part 323 delimited by the circular discharge opening 321.

Each filling spout 32 is fitted with a collecting member 4, secured to the spout, surrounding it at its discharge opening, and that exhibits a circular passage opening 41 arranged in the perpendicularity of the discharge opening 321 according to the longitudinal axis C of the filling spout 32. This passage opening has a higher diameter than that of the discharge opening to allow the passage of a bottle neck during filling operations. Each collecting member 4 comprises a lateral evacuation duct 42 opening into the internal space of the collecting member. The evacuation ducts 42 will advantageously be radially arranged with respect to the axis of the tank and connected, for example by flexible ducts, to a manifold mounted under the bottom wall of the tank and connected to the tank by a circuit fitted with a pump for recycling the cleaning agent towards the tank in a closed circuit fashion.

In the present embodiment, the filling spout and its collecting member are formed of one single piece externally exhibiting the shape of a simple cylinder, the cylindrical wall of the upper part 322 of the spout extends beyond its tapered part 323 to form a skirt constituting said collecting member, the lower edge 43, here of circular shape, of each collecting member 4 defining said passage opening 41.

With reference to FIG. 9, the holder means 31 for holding a container B, when it concerns a bottle, are mounted at regular angular spaces on a ring 34 arranged in the central hollow area of the tank, this ring being for example fixed to the internal cylindrical wall 23 of the tank. Each holder means comprises a holding member 311, for example a clip, capable of gripping the bottle under its flange located at the base of its neck, a stand 312 to support the bottle from its bottom, and an intermediary wedge 313 coming against the bottle cylindrical wall. The clip comprises for example two opposite levers 311*a* pivotally mounted on a sub-plate 311*b*. The levers are elastically biased by springs in a position in which the bottles are clamped, and are capable of being elastically spaced apart to allow the introduction or the withdrawal of a bottle. The clip is assembled by its sub-plate at the free end of a stem 314*a* mounted on the aforementioned ring 34. A vertical stem 315 mounted on the sub-plate of the clip bears said stand 312 at its lower end, as well as the intermediary wedge 313.

Metering means, known per se, are associated to each filling spout to supply a determined quantity of product in each bottle brought under the filling spout. These metering means, for example of weight type, comprise a check-valve 33, mounted in the filling spout and controlled to open and close by a jack (not shown), this jack being arranged at the upper part of the tank and servo-controlled by a weighting system 134 associated to the stem 134*a*. The machine according to the invention could be equipped with other metering means, for example of volumetric or flow metering type, or allowing for the detection of the container filling level.

The machine would further comprise an empty bottle intake system, such as a conveyor belt, and an evacuation system, constituted for example of a downstream portion of the aforementioned conveyor belt, allowing for the evacuation of the filled bottles.

Figure 2:
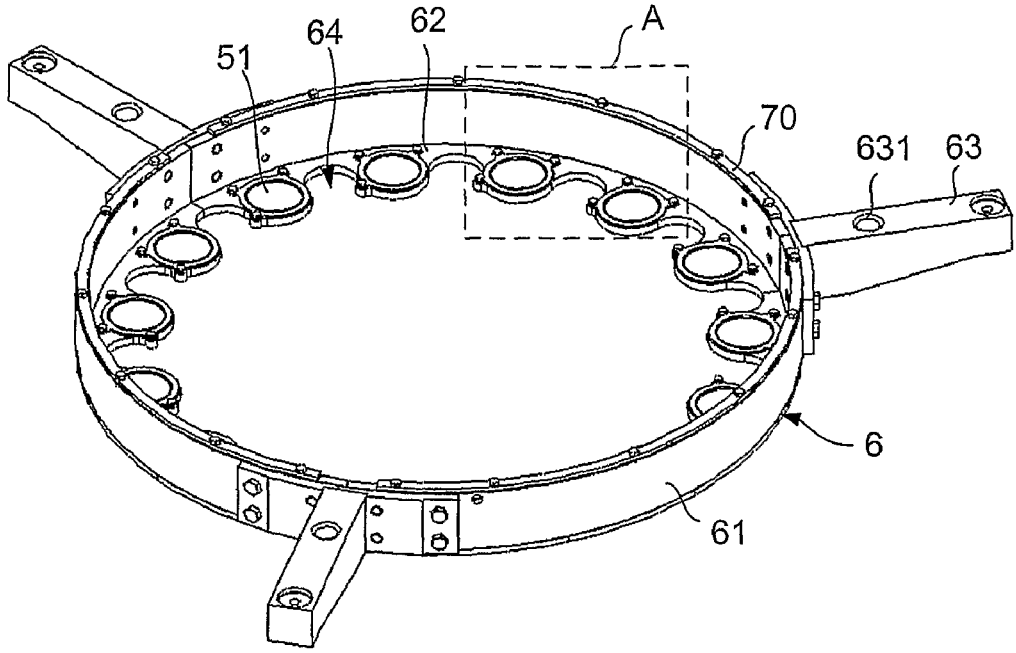
FIG. 2 is a perspective view of the ring of sealing members of the cleaning device of FIG. 1.
Figure 3:
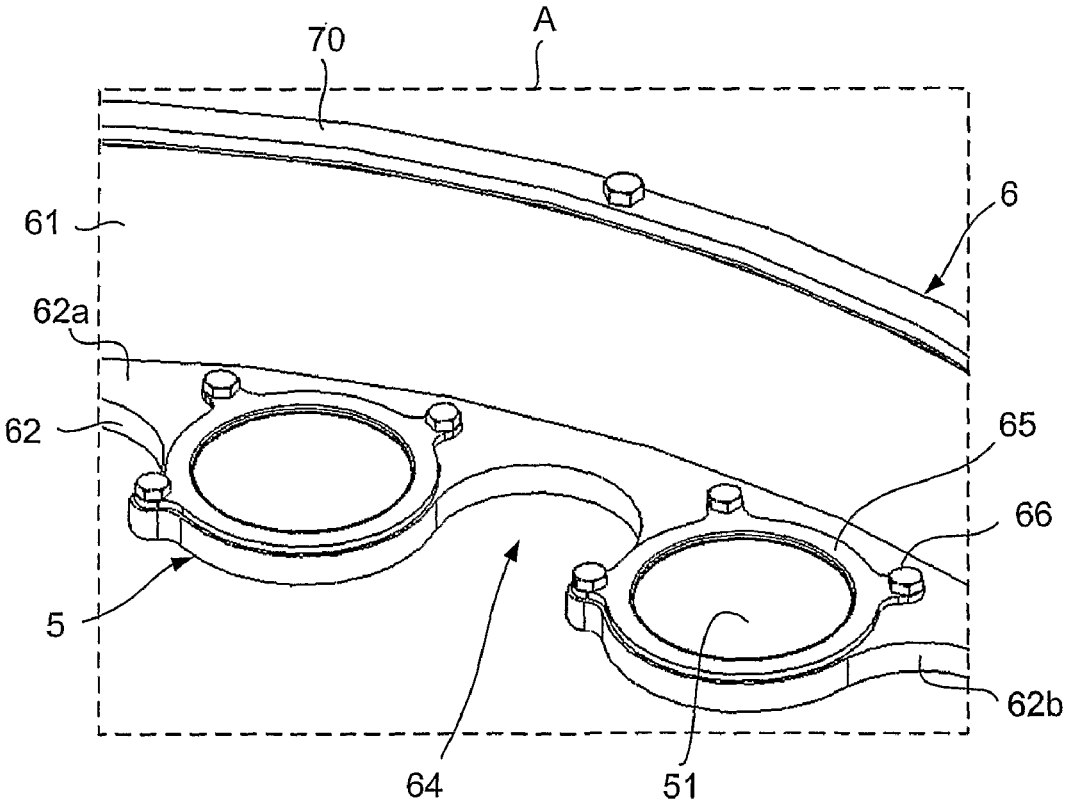
FIG. 3 is an enlarged view of detail A of FIG. 2.

In combination with the aforementioned collecting members, the cleaning device comprises a plurality of mobile sealing members 5, capable of sealing the passage openings 41 of the collecting members. With reference to FIGS. 2 and 3, these sealing members 5 comprise circular deformable membranes 51 carried by a same ring 6, said ring being movably mounted on the tank 2. The ring comprises a vertical cylindrical wall 61, with a diameter higher than that of the circle defined by the filling spouts during the rotation of the tank, this cylindrical wall bearing a holder 62, shaped as a horizontal annular plate, and that extends inwards from the lower edge of the cylindrical wall, as well as legs 63 extending radially outwards. The membranes are mounted at regular angular spaces on the upper surface 62*a* of the holder plate, according to a spacing pitch between membranes corresponding to that of the filling spouts, and according to a circle corresponding to that defined by said filling spouts. The holder plate exhibits between the membranes cutouts that define openings 64 of sufficient dimensions to allow the vertical passage of the spouts, such as described hereafter. The holder plate thus exhibits an alternation of membranes for the cleaning operations and openings for the filling operations. In the illustrated embodiment, the inner circular edge 62*b* of the holder plate exhibits an alternation of concave portions and convex portions respectively delimiting said openings 64 and areas for mounting the membranes on the upper surface 62*a* of the holder plate. Alternatively, the holder plate may exhibit a circular inner edge, said openings being formed by circular cutouts through the holder plate.

Figure 4:
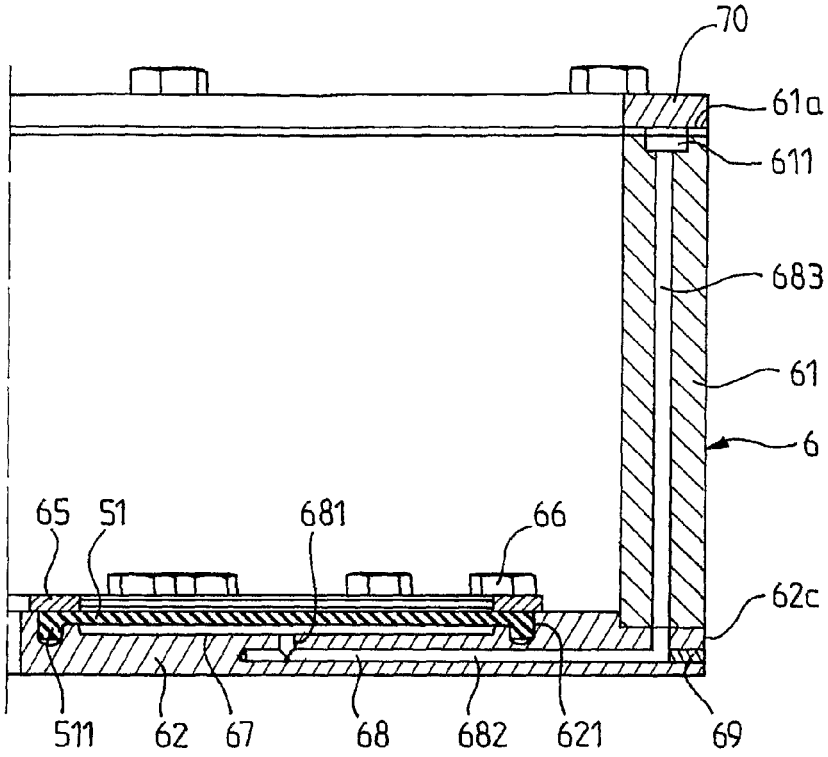
FIG. 4 is an enlarged partial cross sectional view of the ring of FIG. 2, according to a radial cut plane passing by the supply channel of a sealing member in a non inflated or non deformed state.

With reference to FIGS. 4 and 5, each membrane is tightly mounted in a circular recess 621 of the holder plate, and is held therein by means of an annular mounting flange 65 fixed on the holder plate by means of screws 66, for example, three screws. The membrane forms with the recess bottom a deformation chamber 67. To ensure a good positioning of the membrane in the recess as well as a good tightness, the membrane is fitted with a peripheral ridge 511 that is housed in a corresponding annular groove 621*a* of the recess. In order to slightly space apart the membrane with respect to the recess bottom, said groove is defined by an annular rib 621*b* provided on the recess bottom, the membrane thus being stretched on this annular rib at a distance from the recess bottom.

The deformation chamber 67 may be supplied with pressurized fluid by a supply channel 68 opening onto the recess bottom. Each supply channel is constituted of a first vertical bore 681 formed from the center of the recess and opening onto a second horizontal bore 682 formed from the external circular edge 62*c* of the annular plate. One end of this second bore is sealed by a suitable plug 69, and a third vertical bore 683 formed in the thickness of the cylindrical wall 61 from its upper edge 61*a* opens into the second bore, the supply of fluid being carried out from this upper edge of the ring.

In order to facilitate the mounting of the ring on the tank, the ring is formed of many portions of a cylinder assembled to each other and each bearing a holder plate annular portion. In the present embodiment, the machine comprises fifteen filling stations, the ring is formed of three portions assembled to each other by the three mounting legs, each ring portion bearing an annular portion whereon are mounted five membranes. Advantageously, the upper edge of each ring portion is fitted with an annular groove 611 in which open the vertical bores 683 of the supply channels of the chambers. The groove is tightly closed with a lid 70 fitted with a seal member. The communication of the groove with a pressurised fluid circuit, for example by means of a flexible duct (not shown) connected up to the lid and connected by a valve system to a compressed air circuit, will allow to simultaneously pressurize all the chambers of a same ring portion. Alternatively, the supply of the chambers is carried out from the lower part of the ring, each supply channel opens at the periphery of the recess and on a groove formed on the lower face of the holder plate, next to its circular external edge 62*c*.

Each membrane is made of an elastomeric material, for example of silicone-type, EPDM nitrile EPT or EPDM. Its diameter, as well as that of its recess 621 are higher than that of the diameter of the collecting members. When the chamber is pressurized, the membrane inflates and becomes deformed outwardly such as illustrated in FIG. 5.

The ring is mounted under the tank, parallel to its bottom wall, and centered according to the rotational axis of the tank, via its mounting legs 63, with a displacement system for displacement in rotation and in vertical translation interposed between its legs and the tank. As shown on FIG. 1, the diameter of the ring is lower than that of the tank, and its mounting legs extend beyond the external wall 22 of the tank. Each leg of the ring is connected via a lift/descent-type vertical jack 81, on a carriage 82, the latter being slidingly mounted on an arc-shaped guiding rail 83 horizontally fixed to the tank, the rotational displacement of the ring with respect to the tank, and around the axis thereof, being achieved with at least one, so-called rotation jack 84, acting on one of the carriages. Particularly according to FIGS. 6A and 6B, the guiding rail 83 is fixed, parallely and at a distance from the external wall of the tank, between two squares 831 assembled by one of their arms to the bottom wall of the tank constituting the aforementioned rotary holder 21. The carriage generally consists of a rectangular fixing plate bearing on one face four diabolo-shaped wheels 832 arranged into an upper pair and a lower pair, the fixing plate being mounted by placing the rail between the two pairs of wheels. The lift/descent-type jack 81 is vertically fixed by its cylinder on the other face of the fixing plate, whereas its free end is assembled to the mounting leg. The cylinder of the rotation jack is pivotally assembled at the end of an arm fixed to the bottom wall of the tank, in order to offset the jack body to the outside, and its free end is pivotally assembled to the carriage, for example on the upper edge of the fixing plate.

Figure 6A:
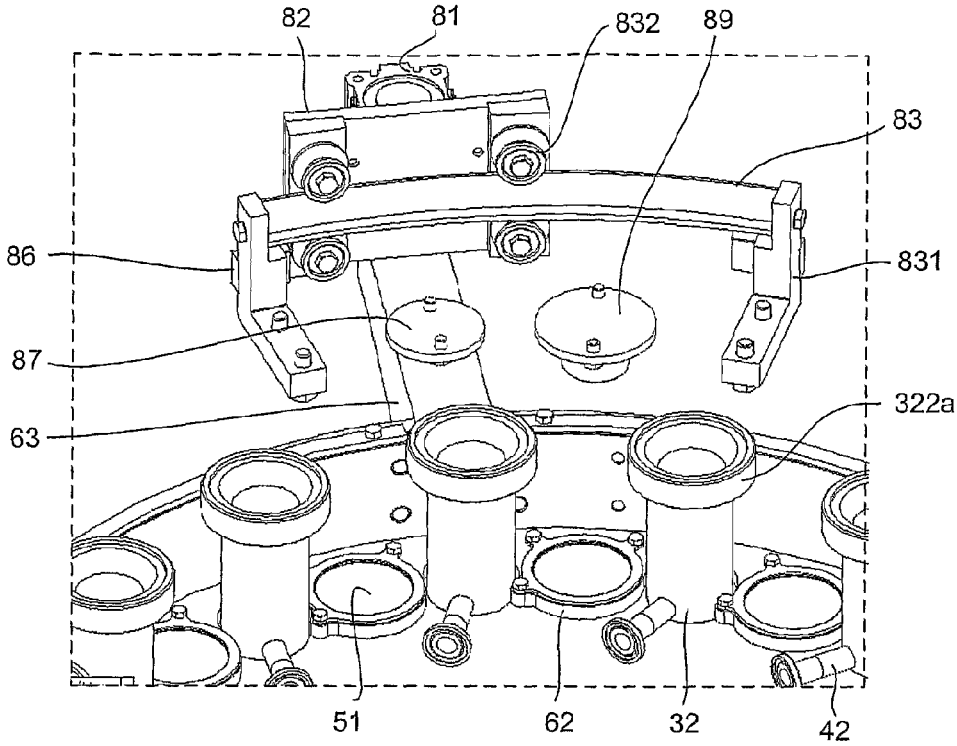
FIGS. 6A and 6B are two partial perspective views of the machine of FIG. 1, illustrating the sealing members in the retracted position, the tank not being shown on FIG. 6A.
Figure 6B:
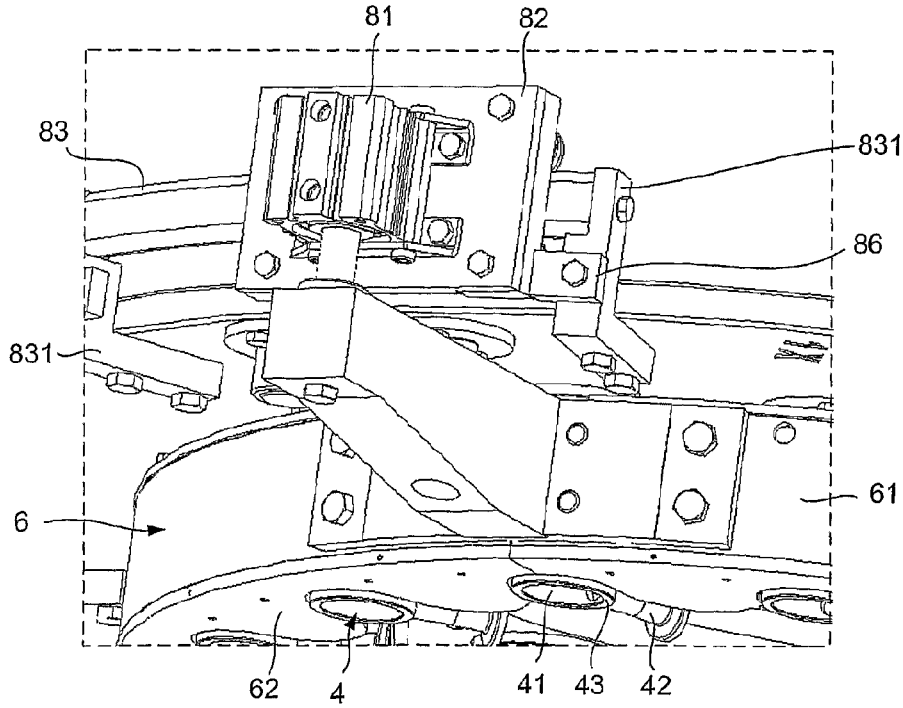

In a so-called high, retracted position of the annular plate or the ring, which is illustrated in FIGS. 6A, 6B and 9, the filling spouts surrounded by their collecting member are arranged at the openings of the holder plate, the lower edge 43 of the collecting members 4 slightly below the holder plate. The membranes are thus embedded between the spouts, directly facing the bottom wall of the tank. The lift/descent-type jacks are in a retracted position, and each of the three carriages abuts against the centering means comprising a straight stopper 86 fixed to one of the squares of its guiding rail. The centering means further comprise three vertical studs 87 mounted by their flange on the bottom wall of the tank, and that are inserted in cylindrical housings 631 (FIGS. 2 and 7) provided on the upper face of the ring legs, in order to rotationally wedge the ring in its high retracted position. These studs further serve as vertical stoppers during the lifting of the ring to its high retracted position.

Figure 7A:
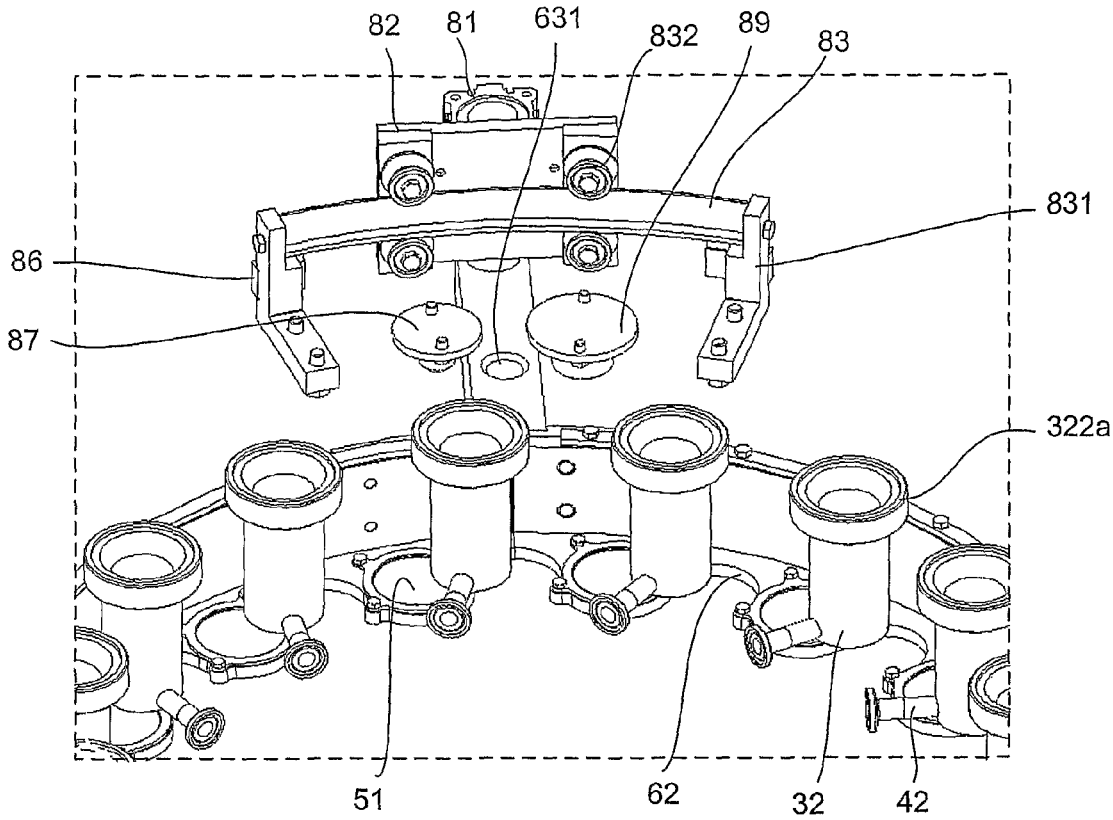
FIGS. 7A and 7B are two analogous views to those of FIGS. 6A and 6B, illustrating the sealing members in a low intermediary position, between a first low position and a second low position.
Figure 7B:
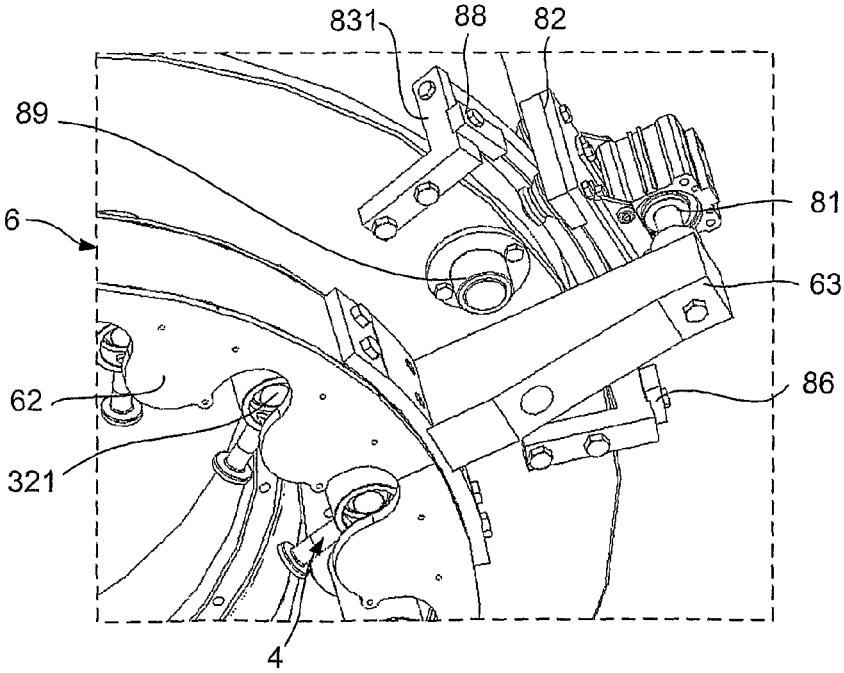
Figure 8A:
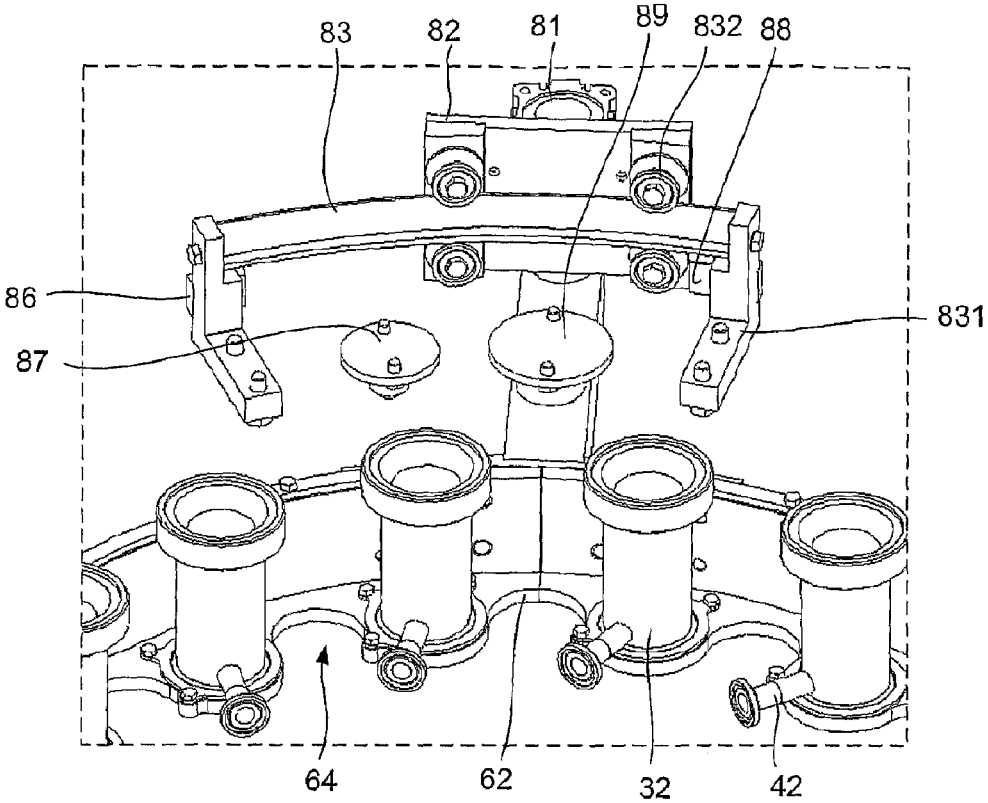
FIGS. 8A and 8B are two analogous views to those of FIGS. 6A and 6B, illustrating the sealing members in the service position.
Figure 8B:
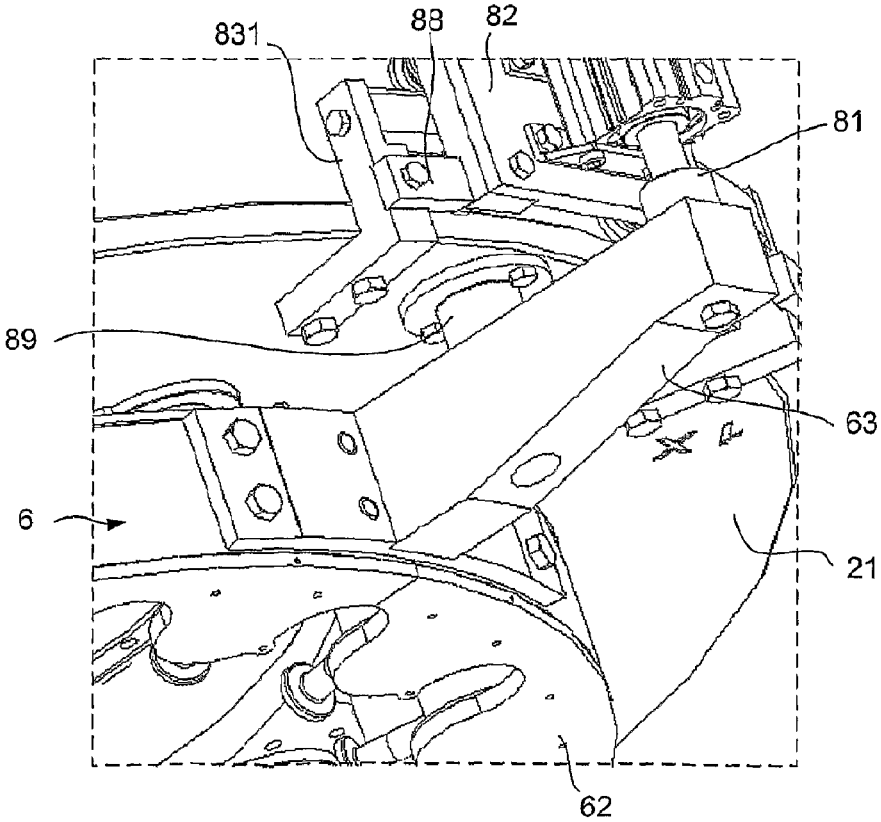
Figure 10:
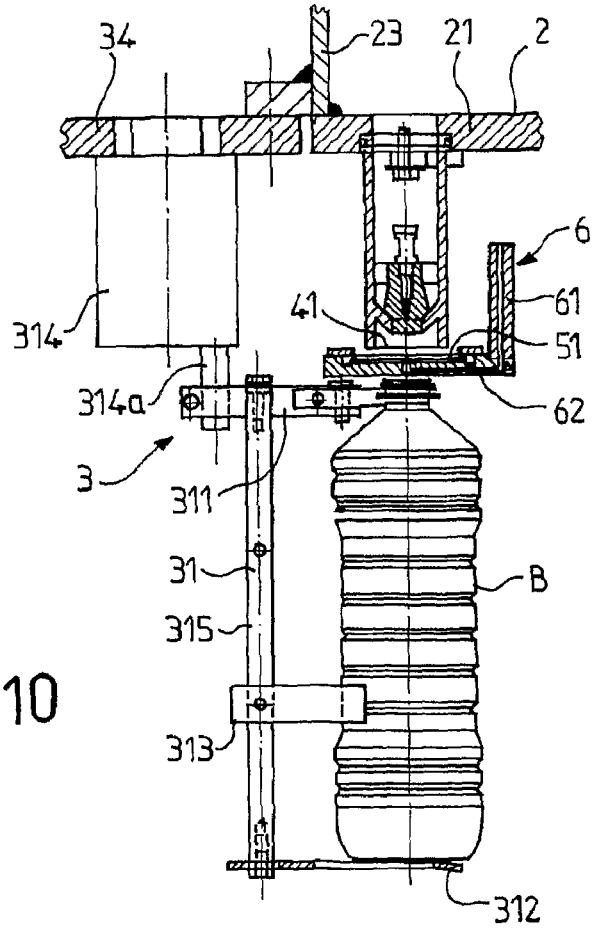

To bring the ring to a service position making it possible to seal the passage openings 41 by means of the deformable membranes 51, the lift/descent-type jacks are first controlled to carry out a downward vertical translation displacement towards the bottom of the ring from the high retracted position to a first low position, wherein the membranes are arranged below the spouts, and particularly below the lower edges 43 of their collecting member 4. The ring is then rotationally displaced clockwise at an angle corresponding to half a pitch between two successive filling spouts, to bring the ring to a second low position wherein the membranes are arranged under the spouts. FIGS. 7A to 7B illustrate an intermediary position of the ring during its rotational movement between the first and second low positions. As illustrated in FIG. 10, whereon the ring is in the second low position, the low positions of the ring are defined such that the holder plate may pass between the holder means 31 for holding a container, particularly the clips, and the lower edge 43 of the collecting members 4. During the rotational movement, the lower edges of the collecting members pass just above of the mounting flanges 65 of the membranes, without contacting them. The screws 66 for fixing the flanges are arranged such that the collecting members pass between the screw heads during the rotation. In this second low position, each membrane is substantially centered according to the longitudinal axis C (FIG. 5) of a spout, the carriages being in abutment with left stoppers 88 of the rail, which constitute another part of the above-mentioned centering means (FIGS. 8A and 8B). Thirdly, the lift/descent-type jacks are then retracted to slightly lift the ring from this second low position to a service position, illustrated in FIGS. 5, 8A and 8B, wherein the lower edges 43 are arranged under the upper surface of the fixing flange. This service position is defined for a theoretical position of the membranes wherein they are arranged just below the lower edges of the collecting members. Nevertheless, depending on possible clearances of a few tenths of a millimeter between the spouts, some membranes may possibly come into contact with the lower edges of collecting members. Three other studs 89 serving as a vertical cleaning stopper are also mounted on the bottom wall of the tank to come in abutment by their free end with the upper face of the legs when the ring is in a service position. These studs 89 may also be partially inserted in the cylindrical housings 631 of the ring legs for the rotational centering of the ring in a service position.

In this service position, a pressurised fluid may be injected in the deformation chambers in order to inflate the membranes so that they abut against the lower edges 43 of the collecting members 4, such as illustrated in FIG. 5, and that they thus tightly close the passage openings.

By way of example, the theoretical distance between the lower edges of the collecting members and the membranes in their non inflated state in the service position of the ring is comprised between 1 and 3 millimeters (mm), for example around 2 mm, the differences in height between the spouts being at the most +/−1 mm. The pressure in the chamber will be comprised between 0.5 and 6 bars, and the vertical deformation of the membrane is comprised between 3 and 7 mm in the absence of a facing spout. This vertical deformation is higher than the differences in height between the filling spouts, and is defined such that the membranes all abut against the collecting members of the spouts, the backpressure in the chamber ensuring a sufficient bearing force for obtaining a good tightness.

Once the cleaning operation is terminated, the membranes are deflated by bringing the deformation chambers to atmospherical pressure, by placing the supply channels in communication with the outside, and the ring is brought to its high retracted position by carrying out the sequence previously described the other way round: downward vertical translation displacement from the service position to the second low position, counter-clockwise rotation of half a pitch to the first low position, then upward displacement by vertical translation in the high retracted position.

During the container-filling operations, the ring is held in a high retracted position and rotates with the tank. For cleaning the machine, a cleaning agent is loaded into the filling liquid tank and the tank is preferably rotationally stopped. The ring is then brought to a service position by actuating the jacks, then, the deformation chambers are pressurized to inflate the membranes and thus seal all the collecting members. The check-valves of the spouts are controlled into open position to make the cleaning agent circulate in the spouts and to recuperate it from the evacuation ducts 42. As described previously, the evacuation tubes are connected to the tank via a manifold for recycling the cleaning agent. The membranes will be held under pressure during the entire duration of the cleaning operation with a cleaning agent.

Alternatively, displacing the ring to its service position is carried out by downward vertical translation then by a half-pitch rotation without an additional upward vertical translation. The service position corresponds to the aforementioned second low position, the membrane thus being capable of deforming itself sufficiently during the pressurization of the chamber to be pressed against the collecting members and ensure their tight closing.

Moreover, according to an embodiment, the membranes may exhibit an annular shape, and be mounted in annular recesses capable of being supplied with pressurized fluid. Thus, this membrane shape, according to the shape of the spouts, make it possible to prevent the membrane, in its inflated state, from coming into contact with the tapered part of the spout, and particularly seal the discharge opening. Alternatively, the membrane may exhibit a circular shape, but with a central circular part of low elasticity, surrounded by an annular part of greater elasticity, such that during pressurization, the annular part of the membrane centered according to the circular edge of the collecting member deforms itself more than the central part.

Although the invention has been described in connection to a particular embodiment, it is to be understood that it is in no way limited thereto and that it includes all the technical equivalents of the means described as well as their combinations should these fall within the scope of the invention.

The invention claimed is:

1. A container filling machine for filling containers comprising at least one filling station comprising a filling spout connected to filling liquid storage means; and a cleaning device comprising, for each filling station, a stationary collecting member surrounding the discharge opening of the filling spout and exhibiting a passage opening for a bottle neck during filling operations arranged below the discharge opening of the filling spout, a sealing member displaceable between a retracted position wherein said sealing member is spaced apart from the filling spout, to allow for the filling of a container placed under the filling spout, and a service position wherein said sealing member is capable of tightly sealing and closing the passage opening of the collecting member to carry out cleaning operations; and displacement means for displacing said sealing member between its service position and its retracted position, the sealing member comprising an elastically deformable membrane mounted on a holder and forming therewith a tight deformation chamber capable of receiving a pressurized fluid in order to deform the deformable membrane to ensure the sealing and closing of the passage opening when said holder is brought to the service position by the displacement means, a diameter of the sealing member being higher than a diameter of the passage opening of the collecting member and the collecting member formed of a substantially cylindrical skirt made in one block with the filling spout, and wherein each collecting member includes a lateral evacuation duct opening into an internal space of the collecting member located above the deformation chamber.

2. The machine according to claim 1, the deformable membrane being mounted on the upper surface of a holder plate, said holder plate being fitted with a supply channel opening under the deformable membrane, and capable of being supplied with pressurized fluid.

3. The machine according to claim 2, wherein the deformable membrane is mounted in a recess of said holder plate, by means of a mounting flange, said membrane exhibiting a peripheral ridge housed in a corresponding groove of the recess.

4. The machine according to claim 1, wherein the collecting member presents a lower edge defining the passage opening, said deformable membrane being capable of pressing against said lower edge during the pressurizing of the deformation chamber.

5. A container filling machine for filling containers comprising:

at least one filling station comprising a filling spout connected to filling liquid storage means, and a cleaning device comprising, for each filling station, a stationary collecting member surrounding the discharge opening of the filling spout and exhibiting a passage opening for a bottle neck during filling operations arranged below the discharge opening of the filling spout, a sealing member displaceable between a retracted position wherein said sealing member is spaced apart from the filling spout, to allow for the filling of a container placed under the filling spout, and a service position wherein said sealing member is capable of tightly sealing and closing the passage opening of the collecting member to carry out cleaning operations; and displacement means for displacing said sealing member between its service position and its retracted position, the sealing member comprising an elastically deformable membrane mounted on a holder and forming therewith a tight deformation chamber capable of receiving a pressurized fluid in order to deform the deformable membrane to ensure the sealing and closing of the passage opening when said holder is brought to the service position by the displacement means, wherein the displacement means are capable of displacing the holder of the deformable membrane from its retracted position to its service position through at least one downward vertical translation displacement, parallel to the longitudinal axis of the filling spout, followed by a horizontal displacement, perpendicularly to the longitudinal axis of the filling spout, such that the deformable membrane is substantially centered according to the longitudinal axis of the spout.

6. The machine according to claim 5, wherein the horizontal displacement is followed by an upward vertical translation displacement substantially according to the longitudinal axis of the filling spout to bring the holder of the deformable membrane to the service position.

7. The machine according to claim 5, including a plurality of filling stations, wherein the deformable membranes on their holder in their retracted position are arranged between the filling spouts.

8. The machine according to claim 7, the holders of the deformable membranes are simultaneously displaced between their retracted position and their service position by joint displacement means.

9. The machine according to claim 8, the machine being of a rotary type, said filling stations being arranged at regular angular spaces under a rotary holder, the deformable membranes on their holders are mounted at regular angular spaces on a ring assembled under said rotary holder via vertical translation and rotation displacement means, said horizontal displacement consisting of a rotation around the rotational axis of the rotary support, at an angle corresponding to half a pitch between two successive filling spouts.

10. The machine according to claim 9, the holders of the deformable membranes are formed of an annular holder plate assembled to the ring, said holder plate being fitted with openings between the deformable membranes to allow for the passage of the filling spouts equipped with their collecting member in the retracted position of the holder plate.

11. The machine according to claim 9, wherein the ring internally bears said holder plate and is fitted with at least two mounting legs extending radially outwards, each leg being assembled by a vertical jack on a carriage that is slidingly mounted on a horizontal guiding rail secured to the rotary holder, at least one jack mounted between the rotary holder and a carriage ensuring the rotational displacement of the ring.

12. The machine according to claim 9, including centering means for centering the ring in the retracted position and in the service position.

13. The machine according to claim 1, each filling station comprising holder means for holding a container comprising at least one holding member capable of cooperating with the neck of a container, said deformable membrane on the holder passing between said holding member and the collecting member.

14. The machine according to claim 1, wherein the container filling machine has a vertical axis and the lateral evacuation duct is radially arranged with respect to said vertical axis.

* * * * *